United States Patent [19]

Fawcett

[11] Patent Number: 4,966,228

[45] Date of Patent: Oct. 30, 1990

[54] REGENERATIVE GAS-TO-GAS HEAT EXCHANGER

[75] Inventor: Sherwood L. Fawcett, Columbus, Ohio

[73] Assignee: Sedum Corporation, Columbus, Ohio

[21] Appl. No.: 311,693

[22] Filed: Feb. 16, 1989

[51] Int. Cl.[5] ..... F28D 17/02

[52] U.S. Cl. ..... 165/4; 165/7; 165/10; 55/388

[58] Field of Search ..... 165/4, 10, 7; 55/388

[56] References Cited

U.S. PATENT DOCUMENTS

| | | | |
|---|---|---|---|
| 1,590,408 | 6/1926 | Bell et al. | 165/4 |
| 1,688,700 | 10/1928 | Gauss | 165/4 |
| 3,225,819 | 12/1965 | Stevens | 165/4 |

*Primary Examiner*—Albert W. Davis, Jr.
*Attorney, Agent, or Firm*—Frost & Jacobs

[57] ABSTRACT

A regenerative gas-to-gas heat exchanger having a plurality of superposed spaced, parallel beds of confined metal flakes adapted for gas flow therethrough; four gas plenums surrounding the beds, each plenum communicating with one side only of all the beds; means for supplying a relatively hot gas to one plenum, means for supplying a relatively cold gas to an opposite plenum, each of the remaining plenums communicating with a separate outlet; and sliding gate valve means in each plenum adjacent one side of the beds, means for moving the gate valve means to a first position and to a second position for controlling the directions of gas flow and alternately extracting and releasing heat therefrom.

16 Claims, 5 Drawing Sheets

REGENERATIVE GAS-TO-GAS HEAT EXCHANGER

BACKGROUND OF THE INVENTION

1. Field of the Invention

This invention relates to a regenerative heat exchanger having particular utility in providing fresh air ventilation without loss of heat or cooling for residential, commercial, and office buildings. The heat exchanger of the invention is compact in size, low in initial cost, and provides high efficiency.

The basic heat transfer mechanism of the apparatus of the invention involves the passage of a gas stream at a given temperature through a plurality of spaced beds of confined, randomly packed metal particles for a predetermined period of time, followed by a second gas stream flowing in the opposite direction through the beds at a different temperature for a similar period of time. Thereafter, the process is repeated continuously, except for the brief period of time during which the gas flows are reversed.

2. The Prior Art Regenerative heat transfer is well known and has many applications, including ventilation of residential, commercial, and office buildings.

The metal particles which are the preferred heat exchange medium in the apparatus of the invention are flakes produced by a known process of rapid solidification applicable to many metals, and currently in use for production of large quantities of aluminum flakes, each flake having a thickness of about 0.03 to about 0.04 mm, and a length and width ranging from about 1.0 to about 1.7 mm. This aluminum flake product is relatively inexpensive.

U.S. Pat. No. 3,233,659, issued Feb. 8, 1966, to F. Nettel et al., discloses cup-shaped pellets of thin-walled metal as a heat exchange medium falling in counterflow to a rising gas stream. The pellets are preferably made of thin stainless or other alloy steel. Mention is made of aluminum or magnesium pellets, but the use thereof is stated to be restricted.

U.S. Pat. No. 4,218,290, issued Aug. 19, 1980, to J. R. Phillips et al., discloses the use of pellets of iron, stainless steel, or aluminum of a particle size of about $\frac{1}{8}$ to $\frac{1}{2}$ inch, in a system for recovery of potable water from saline solutions. A multiplicity of beds is used to heat the saline solution, and a multiplicity of beds is used to condense water while a bed is heated for service.

U.S. Pat. No. 4,349,069, issued Sept. 14, 1982, to H. F. von Beck, discloses a gas-to-gas regenerative heat exchanger having an undefined mass of heat absorbent material. The apparatus includes a housing, a hot end of the heat exchanger having an inlet duct for a heating fluid and an outlet duct for heated air, and a cold end having an outlet duct for cooled fluid and an inlet duct for cool air. Valve means are provided in the inlet and outlet ducts to control the flow of fluid and/or gas therethrough.

Other patents relating to regenerative gas-to-gas heat exchangers include U.S. Pat. No. 2,891,774, issued June 23, 1959, to Theoclitus, U.S. Pat. No. 3,039,745, issued June 19, 1962 to M. K. Drewry; U.S. Pat. No. Re. 17,577 issued Feb. 4, 1930, to W. Dyrssen; and U.S. Pat. No. 1,688,700, issued Oct. 23, 1928, to H. F. Gauss.

Despite the continued development of regenerative heat exchangers over a relatively long period of time, there is still a genuine need for a relatively compact, inexpensive air-to-air regenerative heat exchanger capable of providing fresh air ventilation without loss of heat or cooling, which is highly cost effective in operation.

It is a primary objective of the present invention to provide a regenerative gas-to-gas heat exchanger which fulfills the above need.

SUMMARY OF THE INVENTION

In its broadest aspect, the regenerative heat exchanger of the invention comprises four components, namely, a multiple bed heat exchange section, four plenums, two means for supplying gas, and gate valve means.

A regenerative gas-to-gas heat exchanger in accordance with the invention comprises a plurality of superposed spaced, parallel, four-sided beds of confined metal particles, each of the beds having a thickness permitting gas flow therethrough without substantial pressure drop, the metal particles having a high surface area to bulk volume ratio, a capability of attaining substantially instantaneous temperature equilibrium at any point within a bed and only slight heat conductivity through a bed, an imperforate partition parallel to the beds and separating one half of the beds from another half, thereby preventing gas flow between the one half and the other half; four gas plenums surrounding the beds, each plenum communicating with one side only of all the beds; means for continuously supplying a relatively hot gas to one of the plenums, means for continuously supplying a relatively cold gas to another of the plenums opposite from the one plenum, each of the remaining plenums communicating with a separate outlet; and sliding gate valve means in each plenum adjacent one side of the beds and configured to communicate with spaces between the beds, means for moving the gate valve means in unison to a first position which directs gas flow through one plenum across and through one half of the beds and out of one of the remaining plenums into one of the outlets and which directs gas flow through the opposite plenum across and through the other half of the beds and out of the other of the remaining plenums into the other of the outlets for a predetermined period of time, and to a second position which reverses the gas flows through the beds for the same predetermined period of time, whereby one half of the beds alternately first extracts heat from the gas flow and then releases heat thereto while the other half of the beds alternately first releases heat to the gas flow and then extracts heat therefrom, except during movement of the gate valve means between the first and second positions.

BRIEF DESCRIPTION OF THE DRAWINGS

Reference is made to the accompanying drawings wherein.

DETAILED DESCRIPTION OF THE INVENTION

Present construction techniques for residential housing include the use of large amounts of insulation and general "tightening up" in order to conserve energy. This can result in a degradation of indoor air quality, and the present invention remedies this situation by providing fresh air ventilation without loss of heat or cooling. In addition, concern about radon levels in residential housing in many areas can be addressed by the heat exchanger of this invention since fresh air ventilation removes and discharges to outside atmosphere any build-up of radon gas in an enclosed building.

Figure 1:
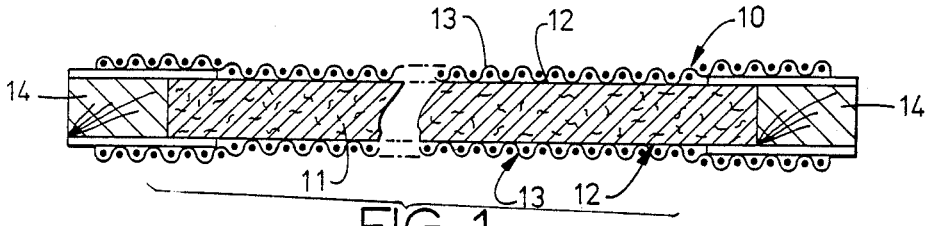
FIG. 1 is a sectional view of a bed of confined metal flakes embodying the invention.

Referring to FIG. 1, a bed of confined metal particles indicated generally at 10 is illustrated in vertical section, preferably comprising aluminum flakes indicated at 11, the flakes being retained between a pair of screens 12 which may be of polyester, metal, or other conventional material. Preferably a pair of mesh hardware screens indicated at 13 is provided overlying the pair of screens 12, the hardware screens being stapled or otherwise secured to an outer frame 14 of wood, plastic, or metal, in order to provide reinforcement to the structure.

As indicated above, the metal particles 11 are preferably aluminum flakes, produced by a rapid solidification process, and each flake has a thickness of about 0.03 to about 0.04 mm, and a length and width ranging from about 1.0 to about 1.7 mm. The bulk flake material has a voidage of about 78% and a very high surface area to unit volume of about 3740 $ft^2/ft^3$. The thermal conductivity of bulk aluminum flakes is about 200 times less than solid aluminum and about 30 times higher than air. The aluminum flake material provides moderate thermal conductivity, very high conductivity within each flake, high voidage, high surface to volume ratio and relatively good corrosion resistance. As a result, the metal flakes in each bed achieve substantially instantaneous temperature equilibrium throughout the bed with only slight heat conductivity through the bulk flakes in the bed, which are necessary and desirable conditions for high heat transfer efficiency. It is within the scope of the invention to use other metals having similar properties, such as stainless steel.

Figure 2:
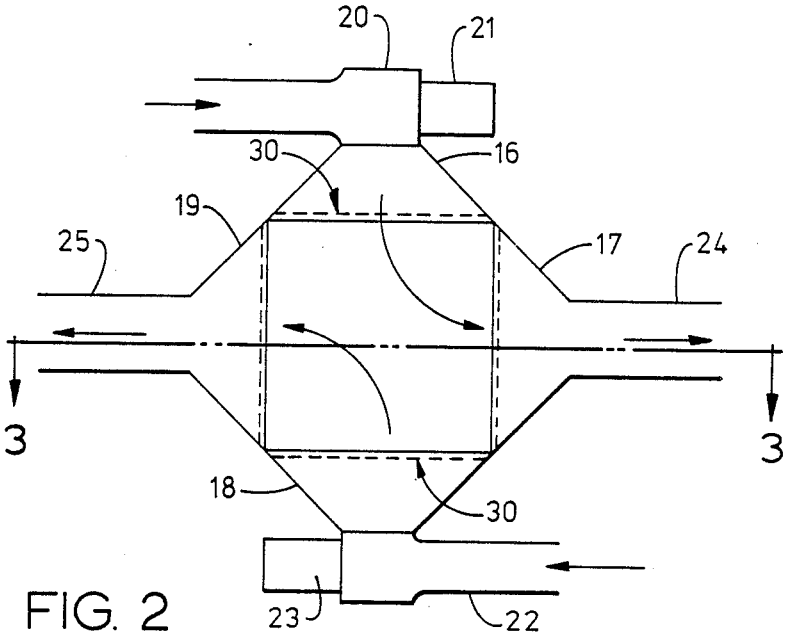
FIG. 2 is a schematic top view of a heat exchanger embodying the invention.
Figure 3:
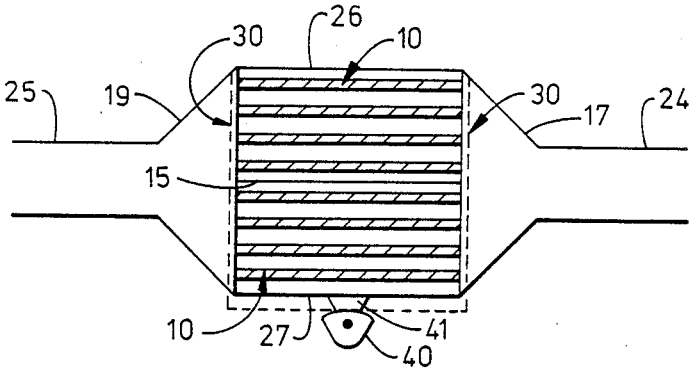
FIG. 3 is a sectional view taken on the line 3—3 of FIG. 2.

As shown in FIGS. 2 and 3, the heat exchanger section is preferably a stack or plurality of superposed, parallel square beds 10, each bed preferably having a thickness of about 6 to about 7 mm, and a space between each bed preferably of about 18 to about 20 mm. The area of each bed and the number of beds is, of course, variable and depends on the rated capacity of the heat exchanger. Preferably, the heat exchanger section is approximately cubic in form. The passages between the beds provide for entrance and exit of gas through the beds, and for flow of gas parallel to the beds.

By way of non-limiting example, a stack of eight superposed beds indicated generally at 10 is shown in FIG. 3. In the preferred embodiment of the invention, an imperforate planar partition indicated at 15 is provided between the upper half and the lower half of the beds, thus preventing gas flow therebetween. As explained in detail hereinafter, this permits continuous flow of gases, both from an inlet for relatively hot gas and an inlet for relatively cold gas, except when the gas flows are being reversed, which is a relatively short period of time not exceeding one second.

In the schematic top view of FIG. 2, four plenums indicated at 16, 17, 18, and 19, respectively, are provided, each plenum communicating with one side only of all the superposed beds 10 of metal flakes. Plenum 16 is connected to a relatively cold gas inlet 20 having a blower 21 which supplies relatively cold gas to inlet plenum 16. Plenum 18, which is opposite plenum 16, is connected to a relatively hot gas inlet 22 having a blower 23 for supplying relatively hot gas to plenum 18.

Plenum 17 is connected to an outlet 24 for hot gas, while the opposite plenum 19 is connected to an outlet 25 for cold gas.

As shown in FIG. 3, the array of superposed beds is surrounded on all four sides by the plenums 16, 17, 18, and 19, while the top is enclosed by a planar member 26 connected in a gas-tight manner to each upper edge of the four plenums. Similarly, a planar member 27 encloses the lower side of the assembly of beds by gas-tight connections to each of the lower edges of the four plenums.

In FIGS. 2 and 3, sliding gate valve means are indicated generally at 30 in a schematic manner. Each plenum is provided with sliding gate valve means adjacent one side of the beds, and the gate valve means are configured to communicate with the spaces between the beds in a manner described in detail hereinafter.

Figure 4:
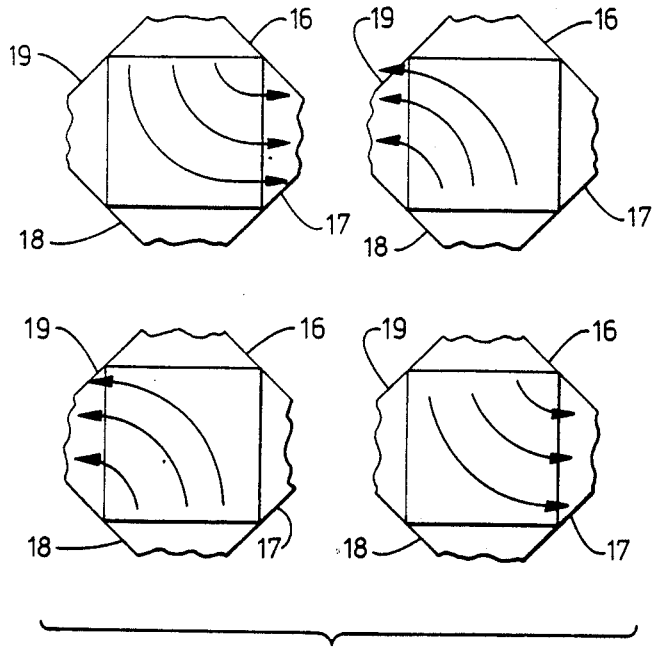
FIG. 4 is a schematic top view illustrating gas flows through a preferred embodiment of the invention.

FIG. 4 illustrates schematically the gas flow directions in the apparatus shown in FIGS. 2 and 3, for the upper half or top level beds and for the lower half or bottom level beds, with the gate valve means in a first position and a second position, respectively. In the first position, relatively cold gas is supplied into plenum 16 to the top level beds only, passing through each of the top level beds into the spaces therebetween, extracting heat from the beds and flowing outwardly through plenum 17 and hot gas outlet 24. Relatively hot gas is supplied to plenum 18 for flow into the lower half or bottom level beds where it flows through each bed and into the spaces therebetween, releasing heat to the beds and then flowing parallel to the beds into plenum 19 and exiting through cold gas outlet 25.

In the second position, the gas flows through the beds are, in effect, reversed. In the top level beds, relatively hot gas is supplied through plenum 18 to the top level beds to release heat thereto, and the gas then flows outwardly through plenum 19 and cold gas outlet 25. In the lower half or bottom level beds, relatively cold gas is supplied through plenum 16 for flow through the beds, extracting heat therefrom, and exiting through plenum 17 and hot gas outlet 24.

It will be recognized that this arrangement provides continuous flow, both of relatively cold gas and relatively hot gas supplied by blowers 21 and 23, respectively, and for continuous flow of relatively hot gas and relatively cold gas through outlets 24 and 25, respectively, except during the relatively brief period of time when the gate valve means are shifted or reciprocated between the first and second positions. There is thus substantially no interruption of flow of heated and cooled gases in the preferred embodiment illustrated in FIGS. 2 and 3, which adds greatly to temperature uniformity and consequent comfort of persons within a building.

Figure 5:
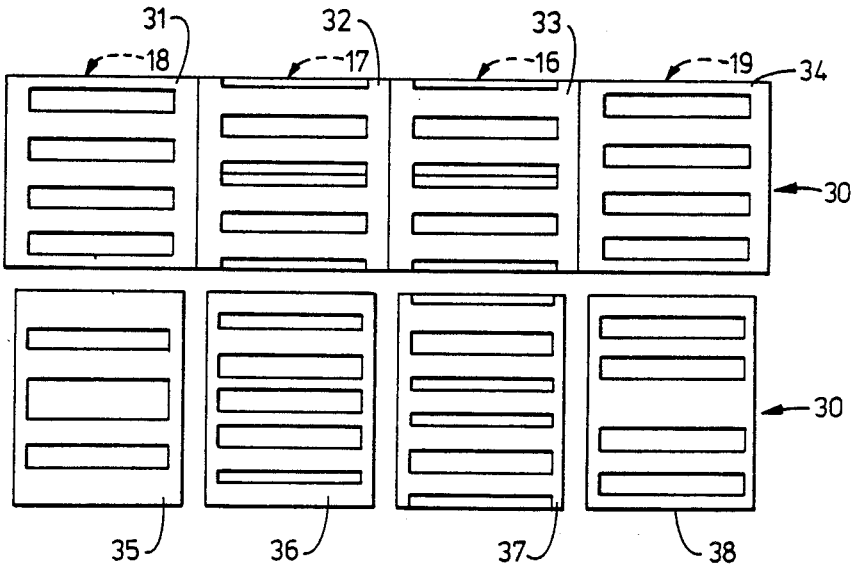
FIG. 5 is a schematic, exploded view of elements of gate valve means embodying the invention.
Figure 6:
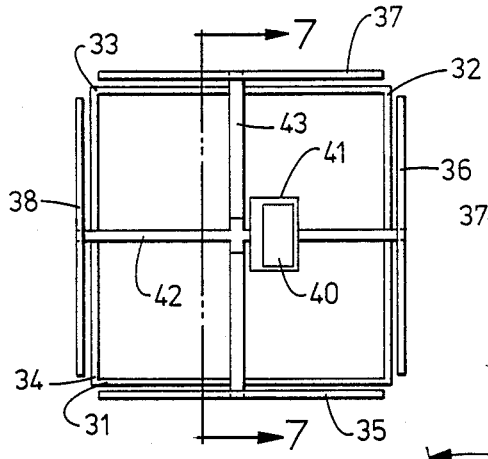
FIG. 6 is a bottom view of gate valve means embodying the invention.
Figure 7:
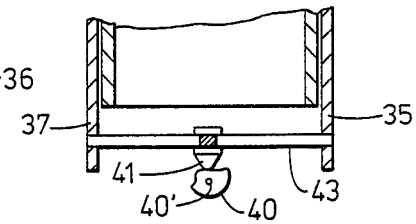
FIG. 7 is a sectional view taken on the line 7—7 of FIG. 6.

FIGS. 5, 6, and 7 illustrate schematically the configuration of gate valve means which may be used for an array of four beds in the upper half and four beds in the lower half of the heat exchanger section as shown in FIG. 3. The gate valve means 30 comprise fixed planar plates indicated at 31, 32, 33, and 34, respectively, in FIG. 5, and sliding gates indicated at 35, 36, 37, and 38, respectively. The fixed gates are provided with a plurality of rectangular openings therein which are so positioned as to be permanently in registry with the spaces between the beds, thus permitting passage of gases therethrough at all times. The relative positioning of openings is the same for fixed gates 32 and 33 which are in plenums 16 and 17, respectively, and the relative positioning of openings is the same in fixed gates 31 and 34 which are positioned in plenums 18 and 19, respectively.

The sliding gates 35, 36, 37, and 38 also comprise planar plates adjacent the fixed plates and having a plurality of rectangular openings therein. The relative positioning of the openings differs in each sliding gate in order to permit registry or alignment with openings in the corresponding fixed gate so as to provide, e.g., passage of gas through one half of the beds and block passage of gas in the other half of the beds in the first position, and vice versa in the second position. In order to accommodate the various flow directions, the relative positioning of the rectangular openings differs in each of the sliding gates, as shown in FIG. 5.

It will be understood that the positioning and number of rectangular openings will vary depending on the number of beds. A person skilled in the art can readily determine the modifications needed.

The sliding gates are reciprocated between the first position and second position, which is a shift of about 19 mm and about the same as the spacing between the beds. In the preferred embodiment of FIGS. 2 and 3, all the sliding plates are shifted in unison. Means for moving the sliding gates 35–38 is shown schematically in FIGS. 6 and 7, wherein a rotating cam means 40 is provided which acts against a cam follower 41 positioned below the bottom closure member 27, the cam follower 41 being connected to or integral with a pair of elongated members 42 and 43, which are secured to one another in a cruciform arrangement, the outer ends of members 42 and 43 being attached to the bottom edges of the four sliding gates.

The cam and cam follower arrangement illustrated in FIGS. 6 and 7 is exemplary only, and it is within the scope of the invention to substitute equivalent means such as a solenoid arrangement to move the sliding gates in unison between their first position and second position. As shown in FIGS. 2 and 3, the sliding gate valve means are generally vertical, so that downward movement of gates 35–38 can be effected by gravity. However, it is within the scope of the invention to provide for positive drive means in both directions if the apparatus is oriented in such manner that the sliding gate valve means are not generally vertical.

It will, of course, be understood that where a cam and cam follower system are utilized, the rotating cam is mounted on a shaft 40' which is connected to a small electric motor (not shown) having suitable timing means adapted to initiate shifting between the first position and second position at predetermined time intervals, e.g. ten seconds.

Referring to FIGS. 8–13, apparatus is illustrated for imparting cyclical reciprocating movement to slidable members. Although not so limited, the apparatus has particular utility in shifting the sliding gates 35–38 of the gate valve means 30 illustrated in FIGS. 5–7.

Figure 8:
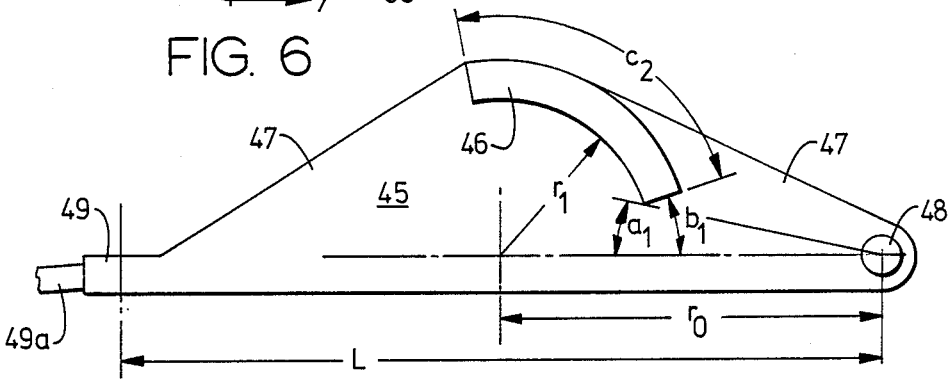
FIG. 8 is a side view of an oscillating arm for imparting cyclical reciprocating movement embodying the invention.

FIG. 8 shows an oscillating arm indicated generally at 45, having a circular female cam surface 46 projecting from a generally planar elongated member 47. The cam surface subtends an arc of less than 90°. The planar member 47 is mounted adjacent one end thereof on a fixed shaft 48. The opposite end 49 of member 47 is adapted to engage any suitable means **49*a* for transferring reciprocating motion of the end 49 to slidable members, e.g. by a linkage to elongated members 42 and 43 (shown in FIG. 6) which in turn are connected to sliding gates 35–38**.

Figure 9:
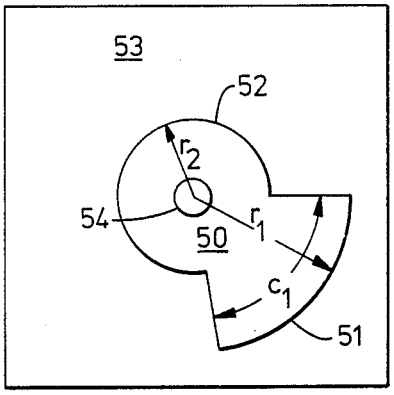
FIG. 9 is a side view of a rotating cam wheel and motor for imparting reciprocating movement embodying the invention.

Referring to FIG. 9, a rotating male cam wheel is indicated generally at 50, having a circular sector 51 of greater radius than the radius of the remainder of the cam wheel shown at 52. The circular sector 51 subtends an arc of less than 90° and has a radius equal to that of the female cam surface 46 with which it engages. A constant speed gear motor is shown schematically at 53 in FIG. 9 having an output shaft 54 on which the male cam wheel 50 is keyed or otherwise mounted axially for rotation with shaft 54.

Figure 10:
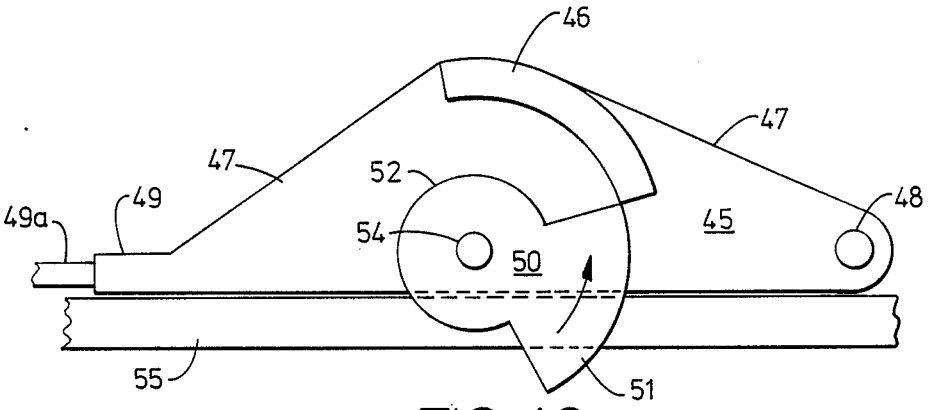
FIG. 10 is a side view of the oscillating arm of FIG. 8 and cam wheel of FIG. 9 in a first position.
Figure 12:
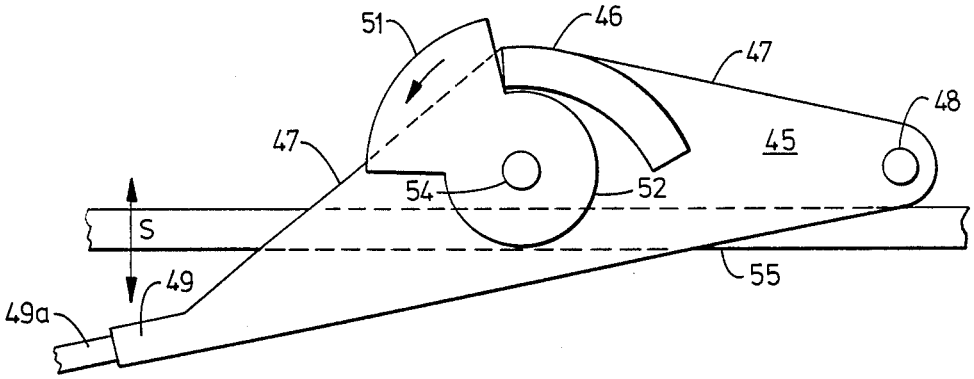
FIG. 12 is a side view similar to FIGS. 10 and 11 showing the arrangement of elements in a second position.

As shown in FIG. 10, the oscillating arm 45, the male cam wheel 50 and motor 53 are mounted on a base plate shown schematically at 55, with the fixed shaft 48 and output shaft 54 parallel to one another and spaced or positioned in such manner that the male cam wheel 50 engages the female cam surface 46 when cam wheel 50 rotates, thus reciprocating oscillating arm 45 between a first position shown in FIG. 10 to a second position shown in FIG. 12.

Figure 11:
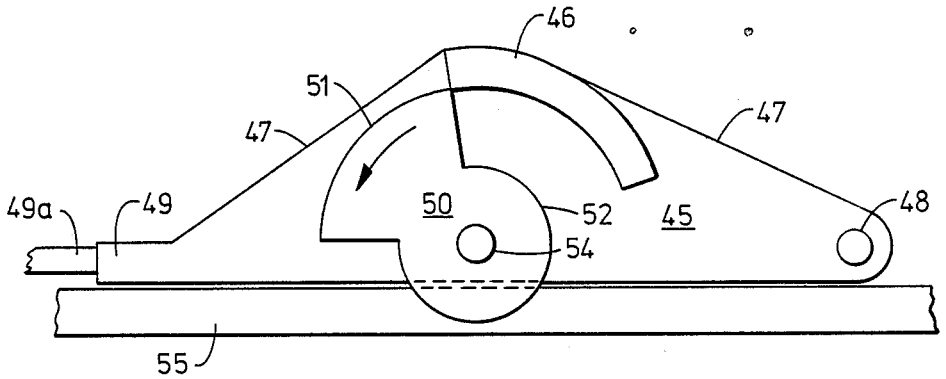
FIG. 11 is a side view similar to FIG. 10 showing the arrangement of elements at the end of the first position.

FIG. 10 illustrates schematically the relative positions of the oscillating arm 45 and cam wheel 50 at the start of the first position. FIG. 11 shows the positioning of these elements at the end of the first position, while FIG. 12 shows the positions at the start of the second position. In this connection it will be understood that cam wheel 50 rotates in a generally vertical plane, so that when cam surface 51 rotates out of engagement with female cam surface 46 as shown in FIG. 12, the oscillating arm 45 swings downwardly (rotating on shaft 48) by gravity until the inner surface of female cam surface 46 contacts the arcuate sector 52 of lesser radius.

Figure 13:
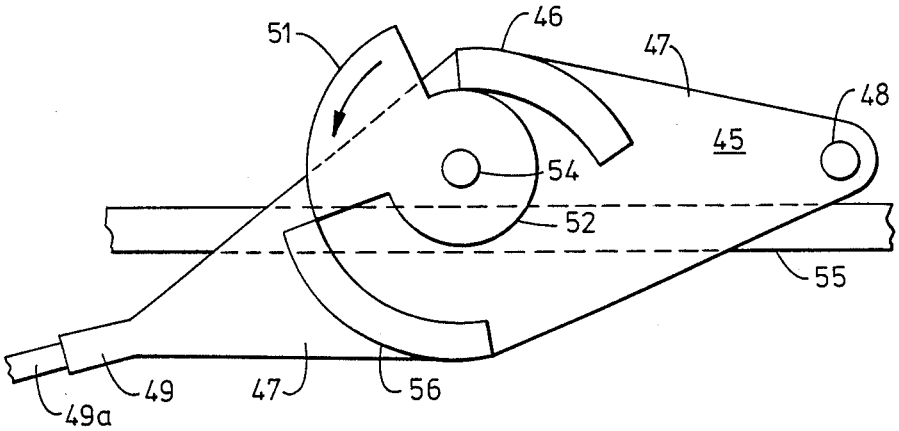
FIG. 13 is a side view of a double-acting positive displacement oscillating arm and rotating cam wheel embodying the invention.

FIG. 13 illustrates an embodiment of the invention wherein positive displacement of oscillating arm 45 is effected both to the first and second positions, rather than relying upon the influence of gravity. In this embodiment oscillating arm 45 is provided with a second circular female cam surface 56, also subtending an arc of less than 90° and positioned about 180° (on center) from the female cam surface 46. As shown in FIG. 13, when the male cam surface 51 rotates (e.g. counterclockwise in FIG. 13) to a position where it engages female cam surface 56, the oscillating arm 45 is rotated by positive displacement to the second position.

Significant angles and dimensions are indicated in FIGS. 8, 9, and 12 as follows:

L=distance from the oscillating arm center of rotation to the output center of displacement;

$r_0$=distance from the oscillating arm center of rotation to the output shaft (and rotating male cam wheel) axis;

$r_1$=rotating cam wheel maximum radius;

$r_2$=rotating cam wheel minimum radius;

S=output displacement of the oscillating arm;

$a_1$=angle of movement of the oscillating arm when the output displacement moves distance S;

$b_1$=angle of movement of the rotating cam wheel to move the oscillating arm through angle $a_1$;

$c_1$=arc of maximum radius of the rotating cam wheel;

$c_2$=arc of the female cam sector on the oscillating arm.

From geometrical examination of the design of the invention, the design parameters require the following relations:

$\tan a_1 = S/L$ $r_1 = r_0 \times \tan a_1 / (\sin b_1 + \cos b_1 \times \tan a_1)$ $r_2 = r_0 \times \sin a_1$.

By way of non-limiting example, assume that output displacement S should be 1 inch and that equal time between both the first and second positions of the oscillating arm is desired. If the following conditions are considered optimum:

(1) the time of movement between positions is to be 10% of the total time;

(2) L equals 5 inches;

(3) $r_0$ equals 2.5 inches;

(4) the cam arc surfaces are to be in maximum contact in order to minimize load per unit area on the cam surfaces; then:

$a_1 = 11.3°$ $b_1 = 18°$ $r_1 = 1$ inch $c_1 = 81°$ $c_2 = 81°$

Tests have been conducted on a prototype system in accordance with the invention in order to determine the optimum bed thickness and time intervals for varying air flows. Pressure drops have been determined, and heat transfer efficiencies have been calculated. These test data are set forth in Tables I–III.

It is apparent from Tables I and II that the heat transfer efficiency ranges between about 80% and about 93%, while the optimum bed thickness is about 6.4 mm ($\frac{1}{4}$ inch), and the optimum switching interval is four seconds. However, for commercial operation, it is considered that a switching interval of about ten seconds would be more appropriate since it would reduce the volume of air which is recycled, would reduce the power requirements, and would reduce wear on the switching mechanism and gate valves. The higher efficiency noted for the 6.4 mm depth bed may be a function of the properties of the flake aluminum material used in the bed. Other metals and other forms such as needles or spheres of steel alloys or the like may have different optimum bed thicknesses, and such modifications are considered to be within the scope of the present invention.

As shown in Table III, the pressure drop across beds of three different thicknesses is relatively low over a relatively wide range of air velocities. Accordingly, high power blowers and high flow rates are not a requirement in the heat exchanger of the invention.

TABLE I

Efficiency vs. Bed Thickness vs. Flow Rate

| Percent Efficiency Bed Thickness (mm) | | | Flow Rate (Ft/Sec) |
|---|---|---|---|
| 3.2 | 6.4 | 9.5 | |
| 85 | 89.5 | 85.5 | 2 |
| 83.5 | 89.5 | 83 | 1 |
| 87 | 90 | 87.5 | 0.5 |

TABLE II

Efficiency vs. Bed Thickness vs. Switch Time

| Percent Efficiency Bed Thickness (mm) | | | Switch Time (Sec.) |
|---|---|---|---|
| 3.2 | 6.4 | 9.5 | |
| 90 | 93 | 88.5 | 4 |
| 85 | 90 | 84.5 | 11 |
| 80.5 | 86.5 | 83.5 | 16 |

TABLE III

Pressure Drop (Across Bed) vs. Air Velocity (Through Bed) vs. Bed Thickness

| Pressure Drop (inches of water column) Bed Thickness (mm) | | | Air Velocity (Ft/Sec) |
|---|---|---|---|
| 3.2 | 6.4 | 9.5 | |
| 0.34 | — | — | 0.95 |
| 0.40 | — | — | 1.25 |
| 0.41 | — | — | 1.9 |
| — | 0.42 | — | 0.55 |
| — | 0.41 | — | 0.61 |
| — | 0.49 | — | 1.2 |
| — | 0.54 | — | 1.4 |
| — | 0.55 | — | 1.6 |
| — | — | 0.53 | 0.41 |
| — | — | 0.51 | 0.78 |
| — | — | 0.55 | 0.9 |
| — | — | 0.55 | 1.1 |
| — | — | 0.55 | 1.3 |
| — | — | 0.55 | 1.4 |

The apparatus of this invention also has utility for applications involving mass transfer. For example, if the metal flakes were coated with a desiccant such as activated alumina or lithium chloride, and relatively hot air and cold moist air were the gases, the cold moist air would be dehumidified and heated while the hot air would regenerate the desiccant by driving off and discharging the moisture picked up by it. The system could thus be used as a dehumidifier and an air heater Similarly, coating of the metal flakes with an absorption or adsorption material could permit removal of contaminants or toxic gas fractions. Contaminants which are adsorbed or absorbed could be desorbed and discharged to atmosphere by the hot air.

Accordingly, the invention further provides apparatus for gas-to-gas heat exchange and mass transfer comprising:

(A) a plurality of superposed spaced, parallel, four-sided beds of confined metal particles, each of said beds having a thickness permitting gas flow therethrough without substantial pressure drop, said metal particles having a high surface area to bulk volume ratio and being coated with absorbent or adsorbent material capable of removing moisture or contaminants from gases passing therethrough, an imperforate partition parallel to said beds and separating one half of said beds from another half, thereby preventing gas flow between said one half and said other half;

(B) four gas plenums surrounding said beds, each plenum communicating with one side only of all said beds;

(C) means for continuously supplying a relatively hot gas to one of said plenums, means for continuously supplying a relatively cold moist and/or contaminated gas to another of said plenums opposite from said one plenum, each of the remaining plenums communicating with a separate outlet; and (D) sliding gate valve means in each said plenum adjacent one side of said beds and configured to communicate with spaces between said beds, means for moving said gate valve means in unison to a first position which directs gas flow through said one plenum across and through said one half of said beds and out of one of said remaining plenums into one of said outlets and which directs gas flow through said opposite plenum across and through said other half of said beds and out of the other of said remaining plenum into the other of said outlets for a predetermined period of time, and to a second position which reverses said gas flows through said beds for said predetermined period of time, whereby said one half of said beds alternately first releases heat to said gas flow and removes moisture and/or contaminants therefrom and then extracts heat therefrom and discharges said moisture and/or contaminants, while said other half of said beds alternately first extracts heat from said gas flow and discharges said moisture and/or contaminants and then releases heat to said gas flow and removes moisture and contaminants therefrom, except during movement of said gate valve means between said first and second positions.

The above and other modifications which may occur to those skilled in the art are considered to be within the scope of the invention, and no limitations are to be inferred except as set forth in the appended claims.

I claim:

1. A regenerative gas-to-gas heat exchanger comprising:

(A) a plurality of superposed spaced, parallel, four-sided beds of confined metal particles, each of said beds having a thickness permitting gas flow therethrough without substantial pressure drop, said metal particles having a high surface area to bulk volume ratio, a capability of attaining substantially instantaneous temperature equilibrium at any point within a bed and only slight heat conductivity through a bed, an imperforate partition parallel to said beds and separating one half of said beds from another half, thereby preventing gas flow between said one half and said other half;

(B) four gas plenums surrounding said beds, each plenum communicating with one side only of all said beds;

(C) means for continuously supplying a relatively hot gas to one of said plenums, means for continuously supplying a relatively cold gas to another of said plenums opposite from said one plenum, each of the remaining plenums communicating with a separate outlet; and (D) sliding gate valve means in each said plenum adjacent one side of said beds and configured to communicate with spaces between said beds, means for moving said gate valve means in unison to a first position which directs gas flow through said one plenum across and through said one half of said beds and out of one of said remaining plenums into one of said outlets and which directs gas flow through said opposite plenum across and through said other half of said beds and out of the other of said remaining plenums into the other of said outlets for a predetermined period of time, and to a second position which reverses said gas flows through said beds for said predetermined period of time, whereby said one half of said beds alternately first extracts heat from said gas flow and then releases heat thereto, while said other half of said beds alternately first releases heat to said gas flow and then extracts heat therefrom, except during movement of said gate valve means between said first and second positions.

2. The heat exchanger claimed in claim 1, wherein each of said beds has a thickness of about 6 to about 7 mm, and wherein said metal particles are aluminum flakes, each flake having a thickness of about 0.03 to about 0.04 mm and a length and width ranging from about 1.0 to about 1.7 mm.

3. The heat exchanger claimed in claim 1, wherein said flakes are confined in said beds between screens which permit flow of gas therethrough.

4. The heat exchanger claimed in claim 2, wherein said flakes have a bulk density of about 35 to about 38 pounds per cubic foot and a voidage of about 75% to about 80%.

5. The heat exchanger claimed in claim 1, wherein said spaces between said beds are from about 18 to about 20 mm, and wherein said sliding gate valve means include planar plates having a plurality of rectangular openings therein adapted to move into registry with said spaces alternatively in said first position and in said second position.

6. The heat exchanger claimed in claim 5, wherein said sliding gate valve means in each said plenum comprises a fixed planar plate having a plurality of rectangular openings therein permanently in registry with said spaces between said beds, and a sliding planar plate adjacent said fixed plate and having a plurality of rectangular openings therein, at least some of said openings in said sliding plate being in registry with said openings in said fixed plate in said first position and being out of registry with said openings in said fixed plate in said second position, or vice versa.

7. The heat exchanger claimed in claim 6, wherein said sliding plate in each said plenum is connected to a common reciprocating cam follower outside said plurality of beds for movement of said sliding plates in unison, and wherein said means for moving said gate valve means comprises rotating cam means acting on said cam follower whereby to reciprocate said cam follower and said sliding plates from said first position to said second position.

8. The heat exchanger claimed in claim 1, wherein said sliding gate valve means in each said plenum comprises a fixed planar plate having a plurality of openings therein permanently in registry with said spaces between said beds, and a sliding plate adjacent said fixed plate movable between said first and second positions and having a plurality of rectangular openings therein, said openings in said sliding plate being so positioned that one half of said openings are in registry with said openings in said fixed plate for said one half of said beds and the other half of said openings are out of registry with said openings in said fixed plate for said other half of said beds when in said first position, and vice versa when in said second position, whereby relatively hot gas is continuously supplied to one of said outlets and relatively cold gas is continuously supplied to another of said outlets except during movement of said sliding plate between said first and second positions.

9. The heat exchanger claimed in claim 8, wherein said sliding plate in each said plenum is connected to a common reciprocating cam follower outside said plurality of beds for movement of said sliding plates in unison, and wherein said means for moving said gate valve means comprises rotating cam means acting on said cam follower whereby to reciprocate said cam follower and said sliding plates from said first position to said second position.

10. The heat exchanger claimed in claim 1, wherein said plurality of superposed beds has a substantially cubic configuration with said beds being generally horizontal, wherein said gate valve means are generally vertical, and wherein said means for moving said gate valve means engage the lowermost ends of said gate valve means.

11. The heat exchanger claimed in claim 2, wherein said aluminum flakes are coated with absorbent or adsorbent material capable of removing moisture or contaminants from gases passing therethrough, and wherein said means for continuously supplying a relatively cold gas includes means for continuously supplying a relatively cold gas includes means for supplying a relatively cold moist and/or contaminated gas, whereby said one half of said beds alternately first releases heat to said gas flow and removes moisture and/or contaminants therefrom and then extracts heat therefrom and discharges said moisture and/or contaminants, while said other half of said beds alternately first extracts heat from said gas flow and discharges said moisture and/or contaminants and then releases heat to said gas flow and removes moisture and/or contaminants therefrom, except during movement of said gate valve means between said first and second positions, thereby effecting mass transfer.

12. The apparatus claimed in claim 11, wherein said absorbent or adsorbent material is a desiccant selected from the group consisting of activated alumina, lithium chloride, and mixtures thereof.

13. Apparatus for gas-to-gas heat exchange and mass transfer comprising:

(A) a plurality of superposed spaced, parallel, four-sided beds of confined metal particles, each of said beds having a thickness permitting gas flow therethrough without substantial pressure drop, said metal particles having a high surface area to bulk volume ratio and being coated with absorbent or adsorbent material capable of removing moisture or contaminants from gases passing therethrough, an imperforate partition parallel to said beds and separating one half of said beds from another half, thereby preventing gas flow between said one half and said other half;

(B) four gas plenums surrounding said beds, each plenum communicating with one side only of all said beds;

(C) means for continuously supplying a relatively hot gas to one of said plenums, means for continuously supplying a relatively cold moist and/or contaminated gas to another of said plenums opposite from said one plenum, each of the remaining plenums communicating with a separate outlet; and (D) sliding gate valve means in each said plenum adjacent one side of said beds and configured to communicate with spaces between said beds, means for moving said gate valve means in unison to a first position which directs gas flow through said one plenum across and through said one half of said beds and out of one of said remaining plenums into one of said outlets and which directs gas flow through said opposite plenum across and through said other half of said beds and out of the other of said remaining plenum into the other of said outlets for a predetermined period of time, and to a second position which reverses said gas flows through said beds for said predetermined period of time, whereby said one half of said beds alternately first releases heat to said gas flow and removes moisture and/or contaminants therefrom and then extracts heat therefrom and discharges said moisture and/or contaminants, while said other half of said beds alternately first extracts heat from said gas flow and discharges said moisture and/or contaminants and then releases heat to said gas flow and removes moisture and contaminants therefrom, except during movement of said gate valve means between said first and second positions.

14. The apparatus claimed in claim 13, wherein said absorbent or adsorbent material is a desiccant selected from the group consisting of activated alumina, lithium chloride, and mixtures thereof.

15. The apparatus claimed in claim 13, wherein each of said beds has a thickness of about 6 to about 7 mm, and wherein said metal particles are aluminum flakes, each flake having a thickness of about 0.03 to about 0.04 mm and a length and width ranging from about 1.0 to about 1.7 mm.

16. The apparatus claimed in claim 13, wherein said spaces between said beds are from about 18 to about 20 mm, and wherein said sliding gate valve means include planar plates having a plurality of rectangular openings therein adapted to move into registry with said spaces alternatively in said first position and in said second position.

* * * * *